United States Patent [19]

Sykes

[11] Patent Number: 5,062,246

[45] **Date of Patent: * Nov. 5, 1991**

[54] PARTITION STRUCTURES AND FRAME ELEMENTS THEREFOR

[76] Inventor: Christopher C. Sykes, 211 Queens Quay West, Apt. 902, Toronto, Ontario, Canada, M5J 2M6

[ * ] Notice: The portion of the term of this patent subsequent to Mar. 6, 2007 has been disclaimed.

[21] Appl. No.: 484,520

[22] Filed: Feb. 26, 1990

Related U.S. Application Data

[63] Continuation-in-part of Ser. No. 271,920, Nov. 16, 1988, Pat. No. 4,905,478.

[51] Int. Cl.[5] ..... E04B 2/82

[52] U.S. Cl. ..... 52/126.4; 52/221; 52/238.1; 52/242

[58] Field of Search ..... 52/220, 221, 239, 243, 52/481, 578, 582, 126.4, 126.7, 126.5, 126.6; 160/135, 351

[56] References Cited

U.S. PATENT DOCUMENTS

| | | | |
|---|---|---|---|
| 4,056,903 | 6/1976 | Guarnere | 52/122 |
| 4,254,442 | 7/1979 | Durham | 52/122 |
| 4,356,672 | 2/1980 | Beckman et al. | 52/36 |
| 4,391,069 | 10/1980 | Vermillion | 52/126.4 |
| 4,391,073 | 12/1980 | Mollenkopf et al. | 52/241 |
| 4,406,101 | 9/1980 | Heidmann | 52/220 |
| 4,535,577 | 8/1985 | Tenser et al. | 52/221 |
| 4,631,881 | 12/1986 | Charman | 52/220 |

OTHER PUBLICATIONS

G. Littleton, "Products—An Ingenious New Office System" Interiors Magazine, Oct. 1988 p. 98 and 99.

*Primary Examiner*—Richard E. Chilcot, Jr.
*Assistant Examiner*—Creighton Smith
*Attorney, Agent, or Firm*—Ridout & Maybee

[57] ABSTRACT

Partition structure has a rigid rectangular frame and rigid rectangular panels received in openings on opposite sides of the frame, with a small clearance between the edges of the panel and the frame. One panel edge is pivotally connected to the frame. The opposite edge of the panel is held securely on the frame by a resilient U-shaped catch received in a slot in a lip on the frame extending rearwardly of the panel. The tongue can be deflected inwardly to free the shoulder from the lip by introducing a thin-bladed tool through the clearance between the panel edge and the frame, so that the panel can then be rocked outwardly about the pivotal connection to an open position. A secure engagement of the panels on the frame is obtained, so that cables or other electrical equipment are securely housed within the partition. By using a small clearance between the panel at the frame, the tongues holding the panels in place are practically indiscernible and the panel securing arrangement is rendered tamper proof. There are also disclosed frame elements and partition structures arranged for stacking of modular frame elements one on another, for connection of structures at angles to form corner units, for support of electrical cables within the frame elements, for attachment of the upper end of a partition to a ceiling, and for levelling of a frame element on an uneven floor.

5 Claims, 13 Drawing Sheets

PARTITION STRUCTURES AND FRAME ELEMENTS THEREFOR5

This application is a continuation-in-part of application Ser. No. 271,920 filed Nov. 16, 1988 (U.S. Pat. No. 4,905,478 dated Mar. 6, 1990).

The invention relates to partition structures and to elements for use in their construction. More especially, although not exclusively, it relates to partition structures for use in offices.

Known partition structures have employed corner posts to which partition members have been connected at points at which it is desired to form an angle or corner in the structures. Often, however it is desired to run electrical power or telecommunication wiring through the interior of the partition structures. The corner posts obstruct such wiring and limit the freedom of arrangement of the supply of the wiring to and between adjacent partition structures.

In the present invention, a corner partition structure is formed from rectangular frame elements having side rails which are interconnected by corner connectors in the form of short lengths of extrusion having connection portions extending adjacent the side rails. Releasable connectors are used to connect between the side rails and the connection portions. The connection portions define a space between them through which electrical cables may be run, so that wiring may be passed vertically through the cavity at the corner. This greatly increases the capability of the structure to have wiring arranged through it.

Further, with known partition structures it has been difficult or impossible to provide the partition with wiring outlets, sockets or receptacles at zones intermediate the height of the partition, for example at slightly above desk height, and usually it has been necessary to run wiring upwardly from sockets, outlets or receptacles at baseboard level. This is inconvenient to the user and subjects the exposed wiring to risk of damage.

In a further aspect, the invention provides partition structures based on rectangular elements formed from peripheral rails defining rectangular openings of uniform size. One or more frame elements is provided with a service cross beam extending across an intermediate portion of an opening. The opening can be covered with a standard size cover panel, or a cover plate may be attached to the service cross beam and a remaining portion of the opening may be covered with a narrow panel attaching to the cross beam and to a peripheral rail of the frame element parallel to the cross beam. The cross beam can be used to support outlets, sockets or receptacles at an intermediate height, e.g. above desk level. The outlets, sockets or receptacles can be accessed through openings in the cover panel. Hence a single, standard frame element may be used either with or without outlets, sockets and receptacles at an intermediate height. In the latter case, the opening having the cross beam across it may be covered by a standard size cover panel.

In other forms or aspects of the present invention there are provided frame elements and partition structures particularly adapted to enable convenient and secure stacking of modular frame elements one on another, connection of capping plates on a top side of the partition, attachment of the upper end of a partition to a ceiling, or levelling of a frame element on an uneven floor. Examples of the above forms of frame elements and partitions in accordance with the invention are described in more detail hereinafter with reference to the accompanying drawings in which.

Figure 1:
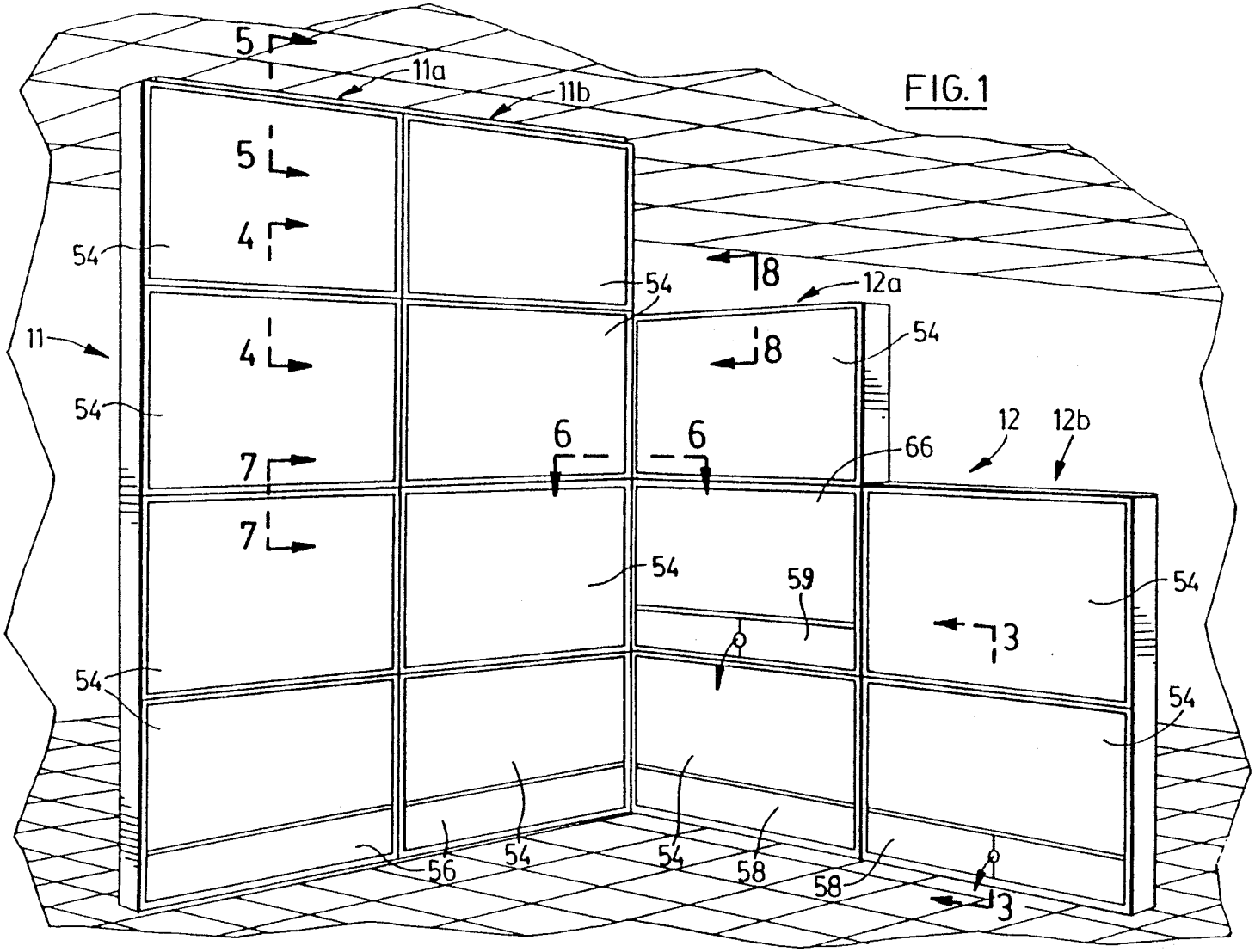
FIG. 1 shows a perspective view of a corner partition structure formed from modular frame elements and facing panels in accordance with the invention.
Figure 4A:
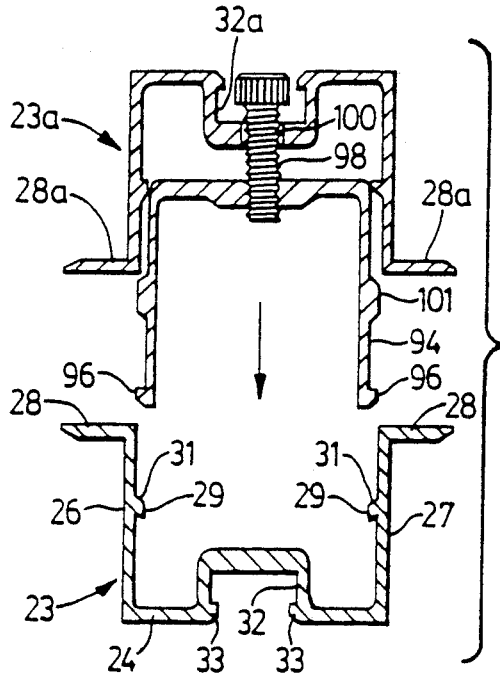
Figure 4B:
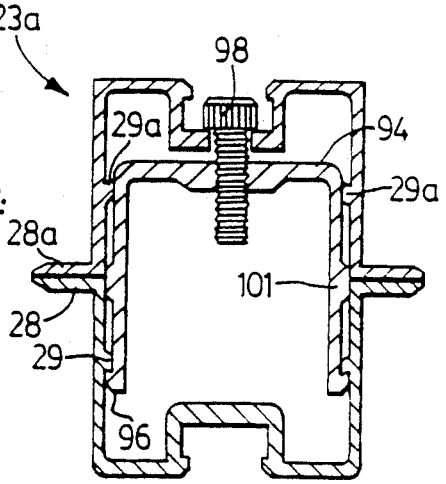
Figure 5A:
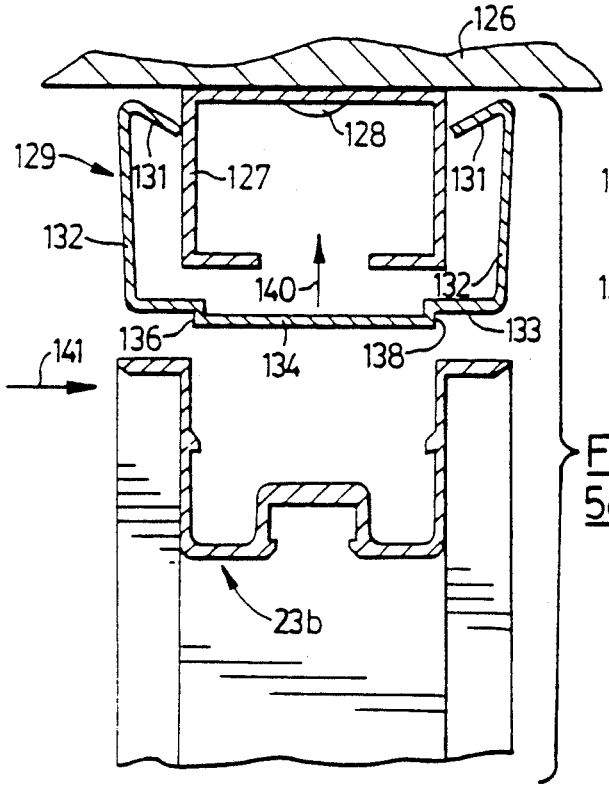
Figure 5B:
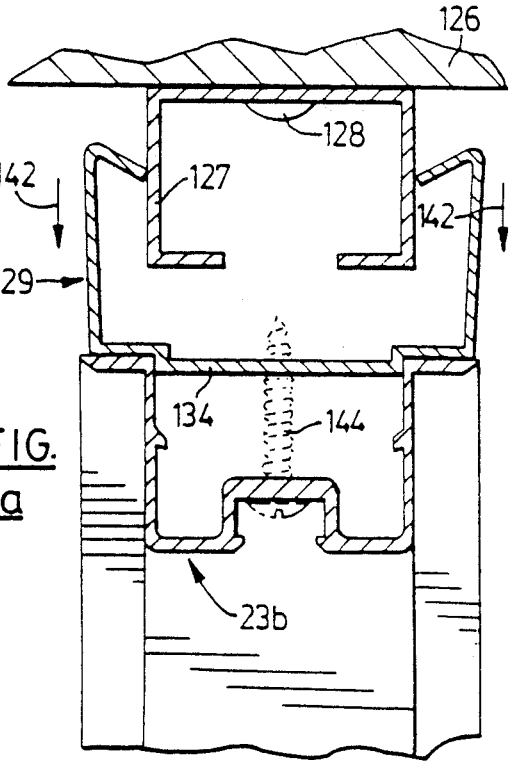
Figure 6B:
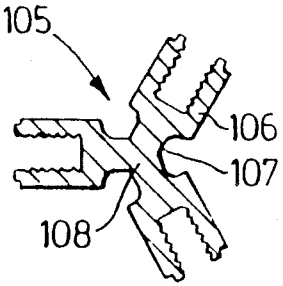
Figure 6A:
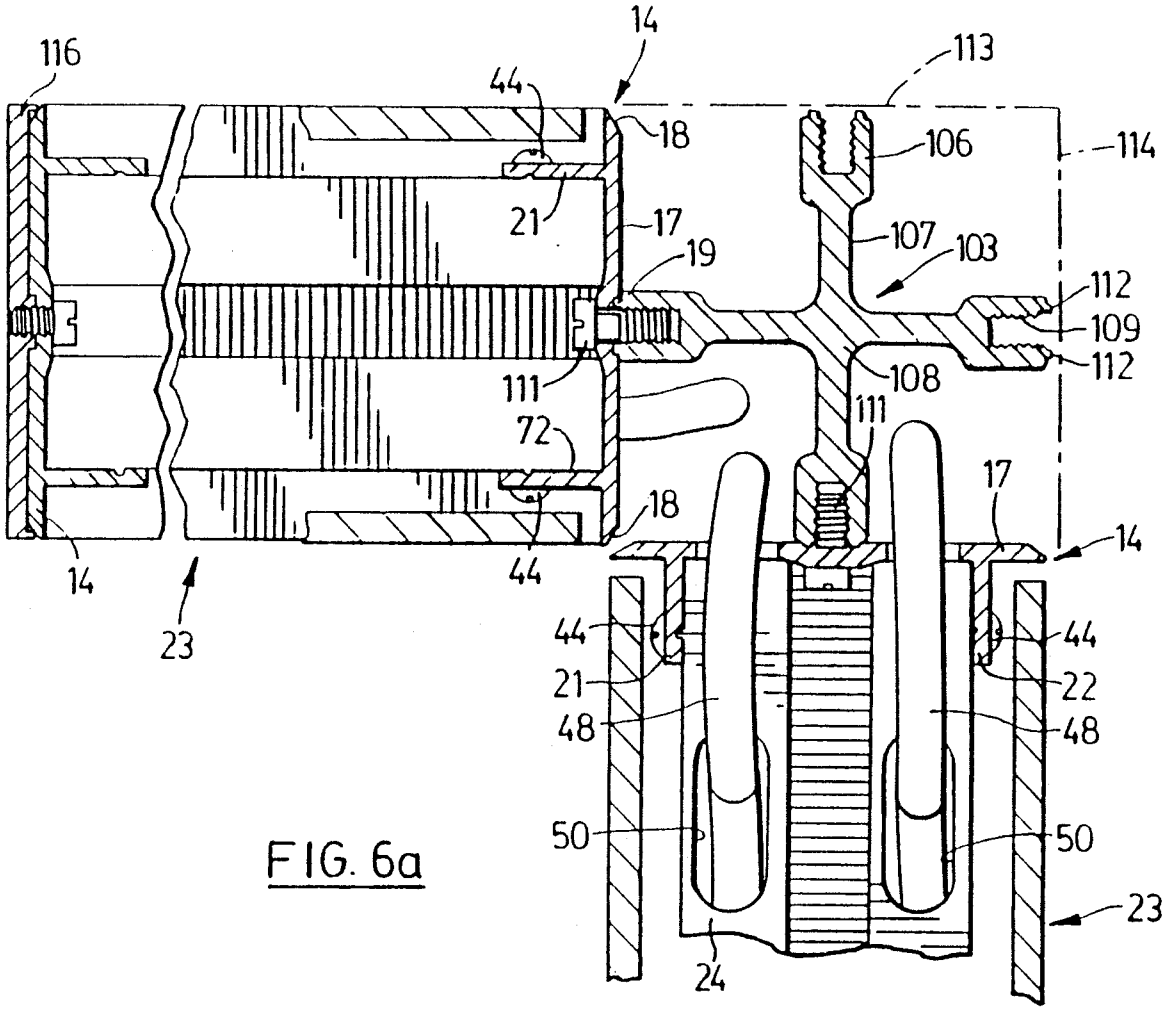
Figure 7B:
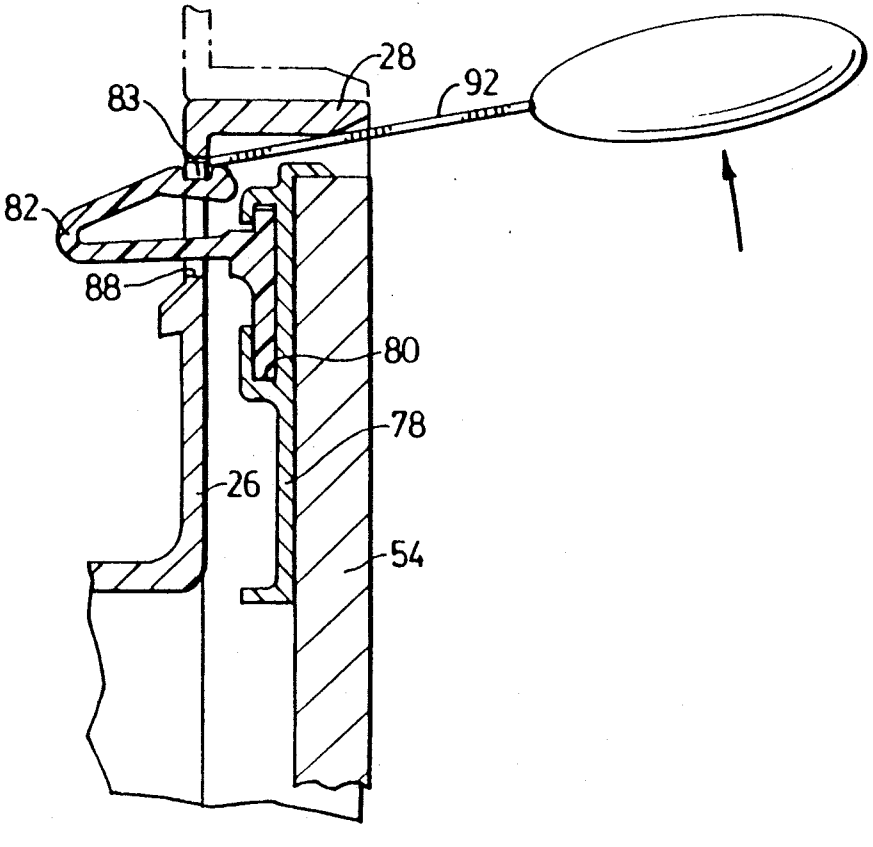
Figure 7A:
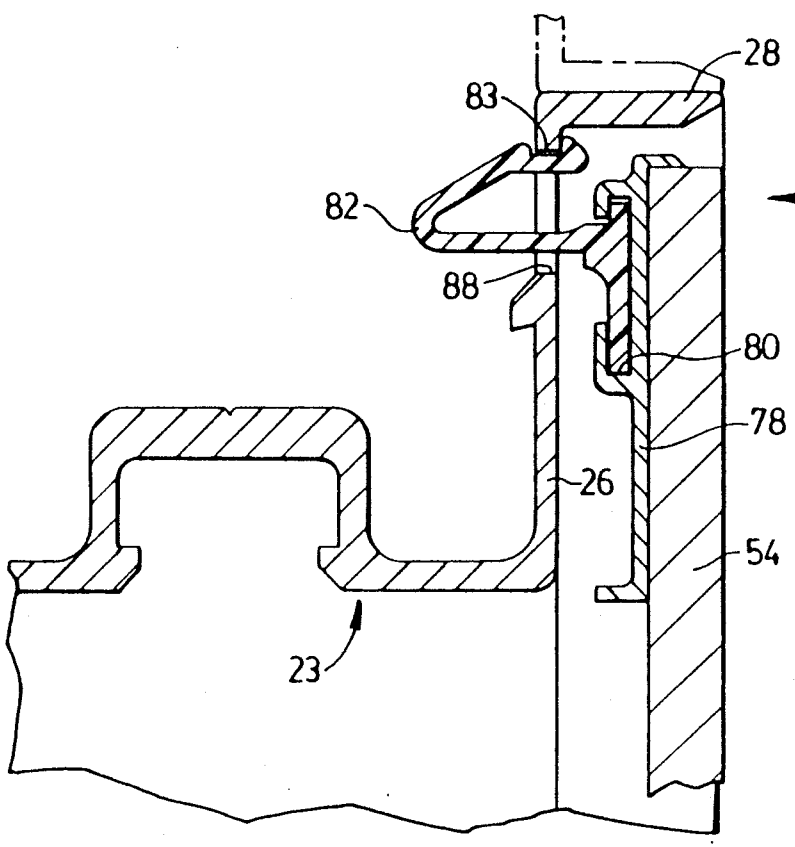

FIGS. 4*a* and 4*b* illustrate the use of one form of an interconnector member for interconnecting modular frame elements one on top of another, and are taken in vertical cross-section on the line 4—4 in FIG. 1;

FIGS. 5*a* and 5*b* illustrate the operation of one form of a ceiling connector member used for attaching the upper end of the partition to a ceiling and are taken in section on the line 4—4 in FIG. 1;

FIG. 6*a* is a horizontal cross-section taken on the line 6—6 in FIG. 1, showing a corner connector used for connecting adjacent partitions together at an angle;

FIG. 6*b* shows a cross-section through a further form of connector for use in joining partitions together at an angle of 120°;

FIGS. 7*a* and 7*b*are vertical cross-sections taken on the line 7—7 in FIG. 1 adjacent the edge of a frame member showing the operation of the resilient panel holding catch.

Figure 8B:
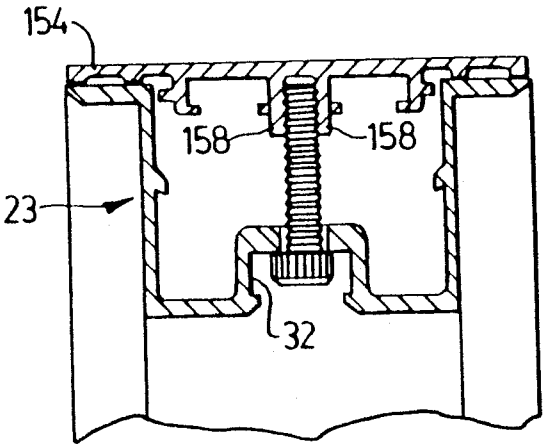
Figure 8A:
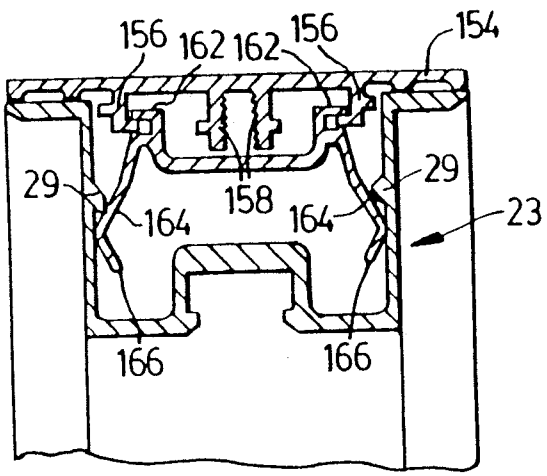
Figure 9:
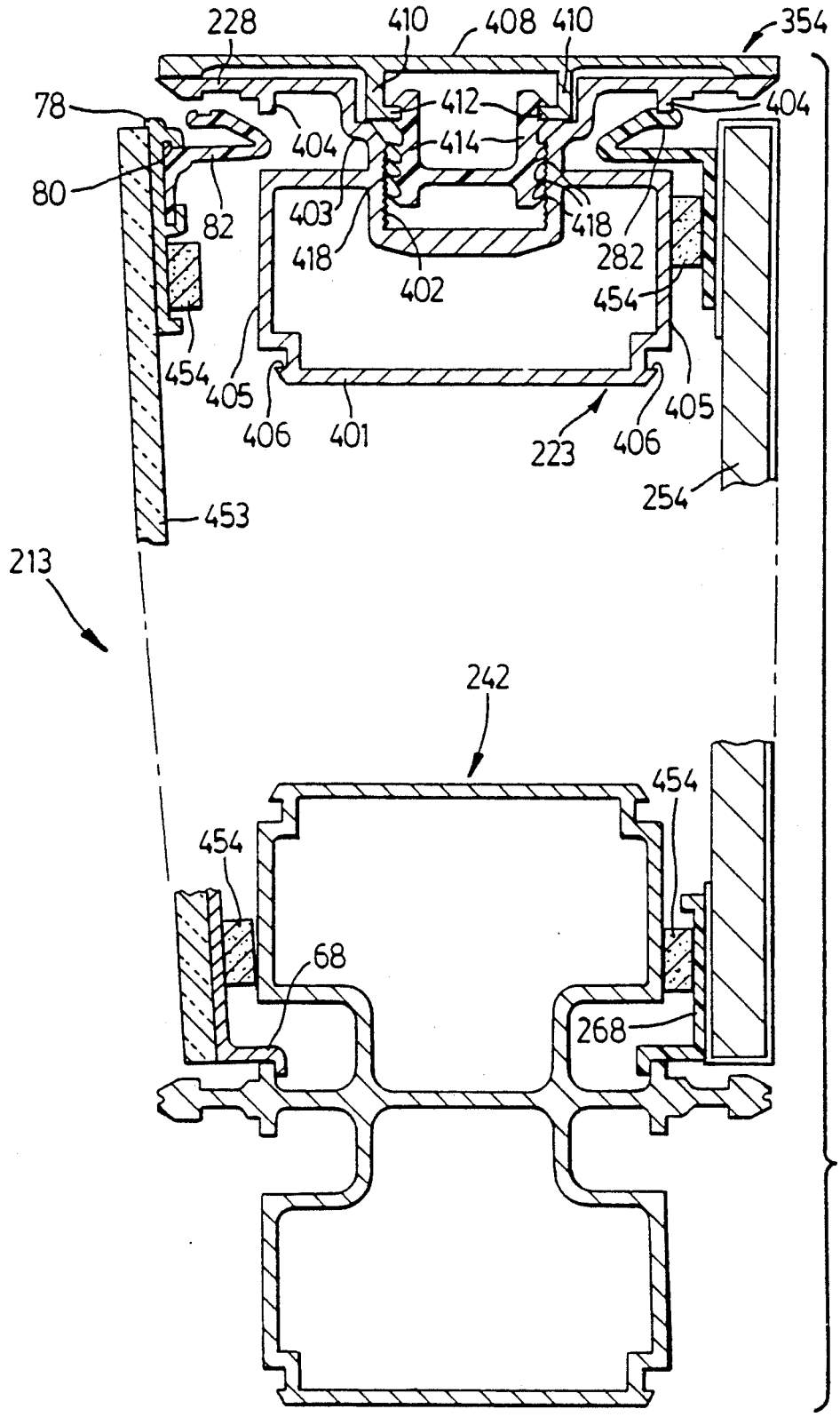
Figure 10:
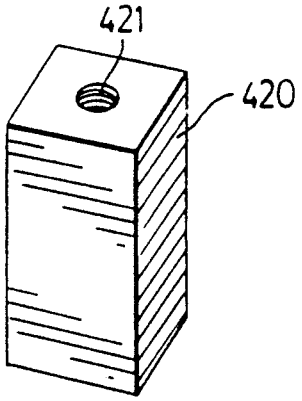
Figure 11:
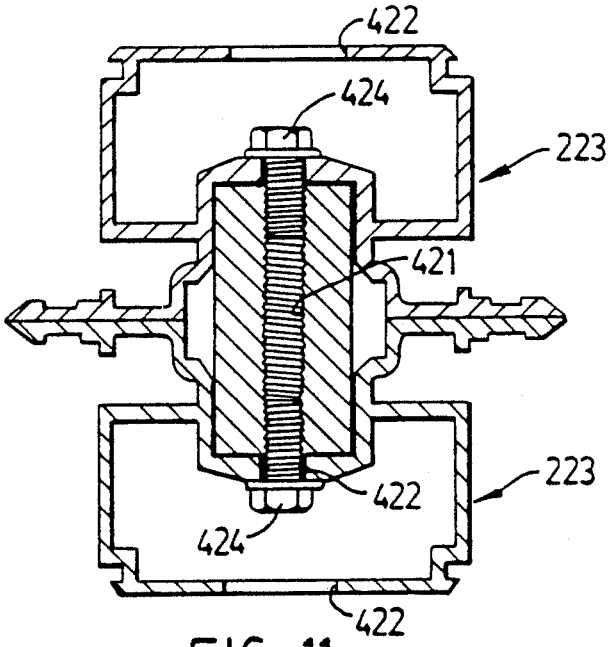
Figure 12:
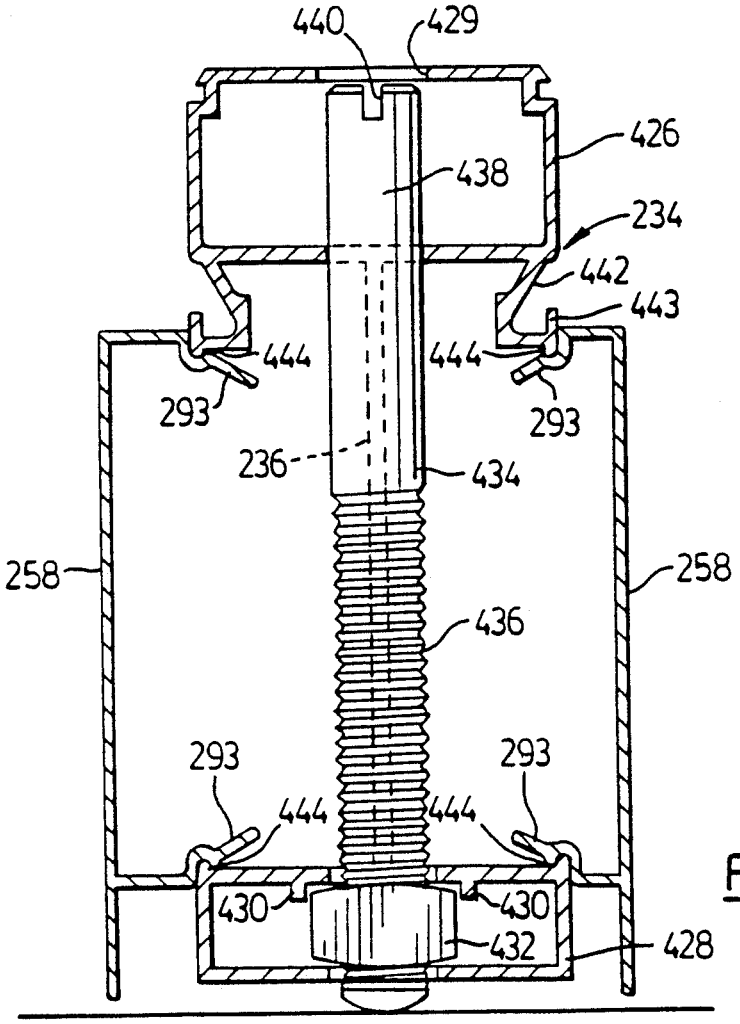
Figure 14:
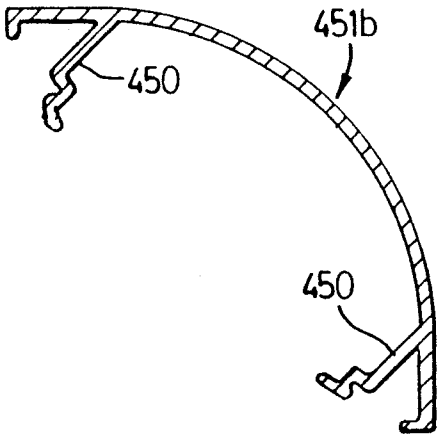
Figure 13:
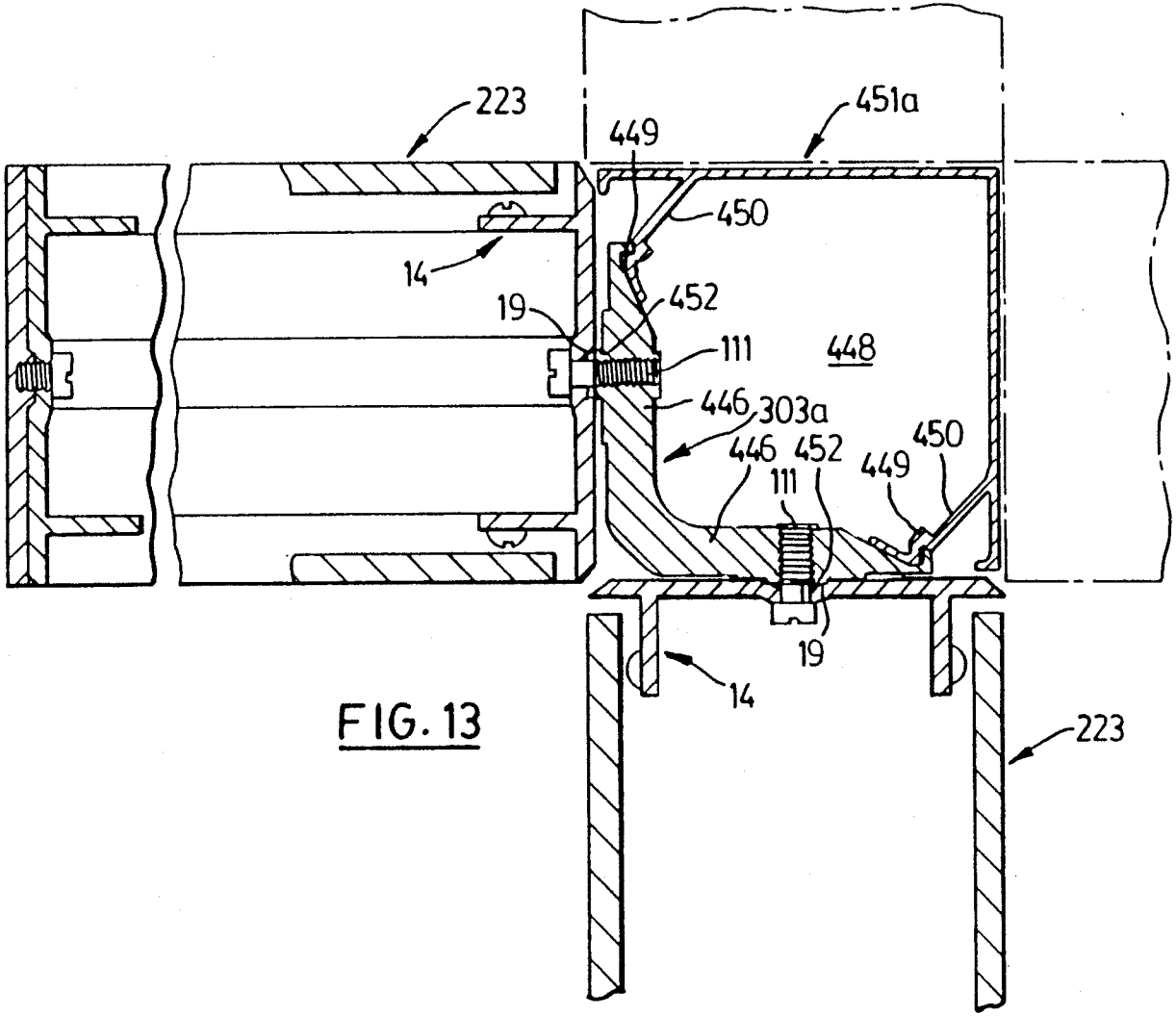
Figure 15:
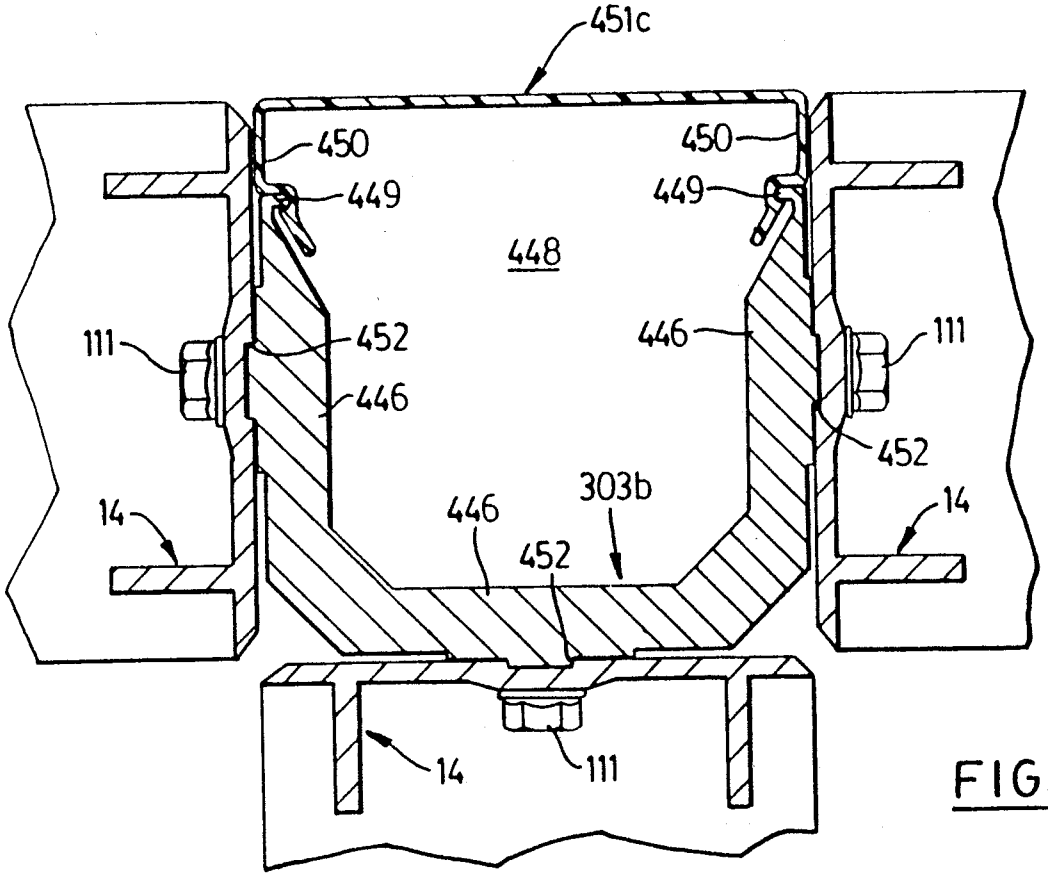
Figure 16:
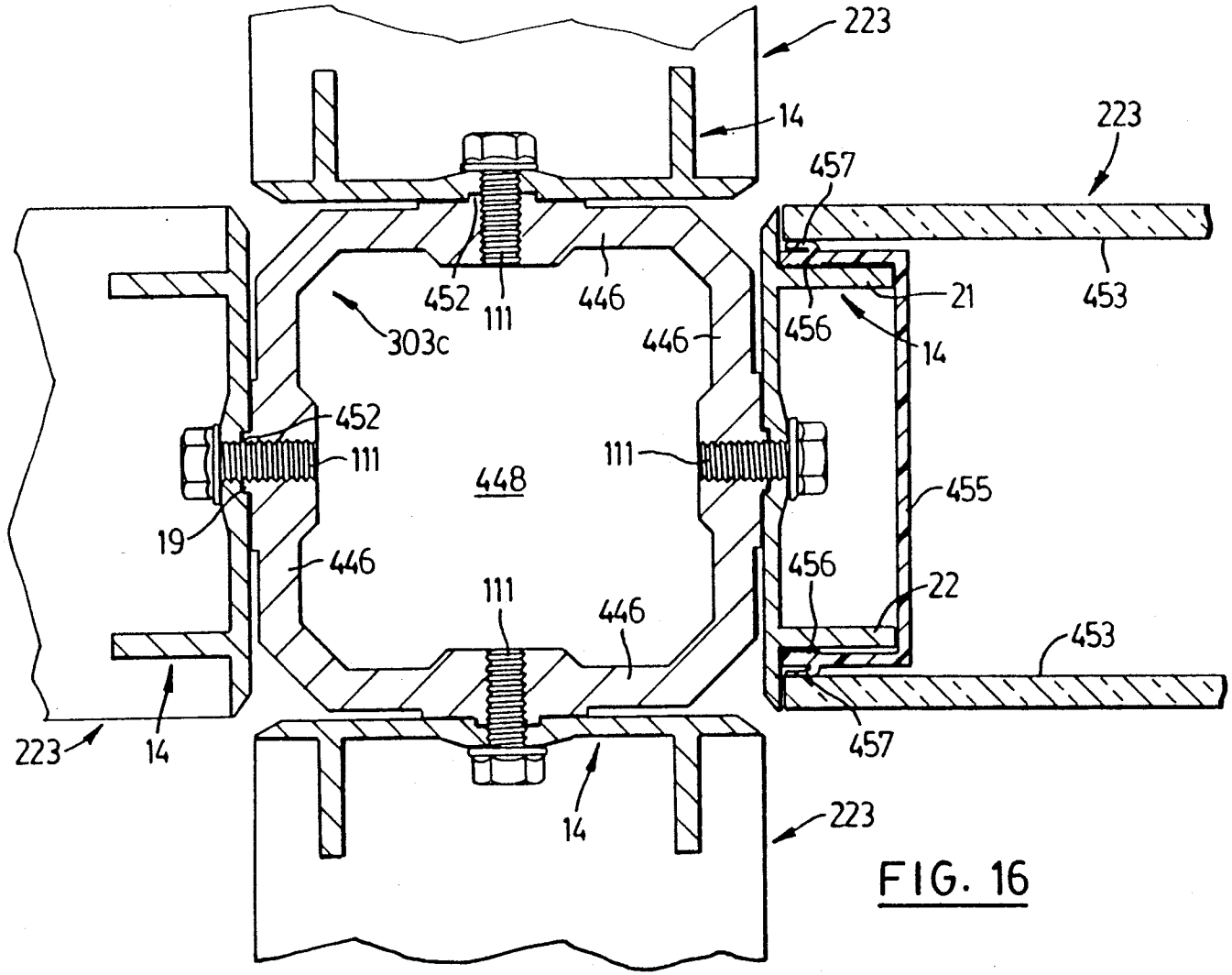
Figure 17:
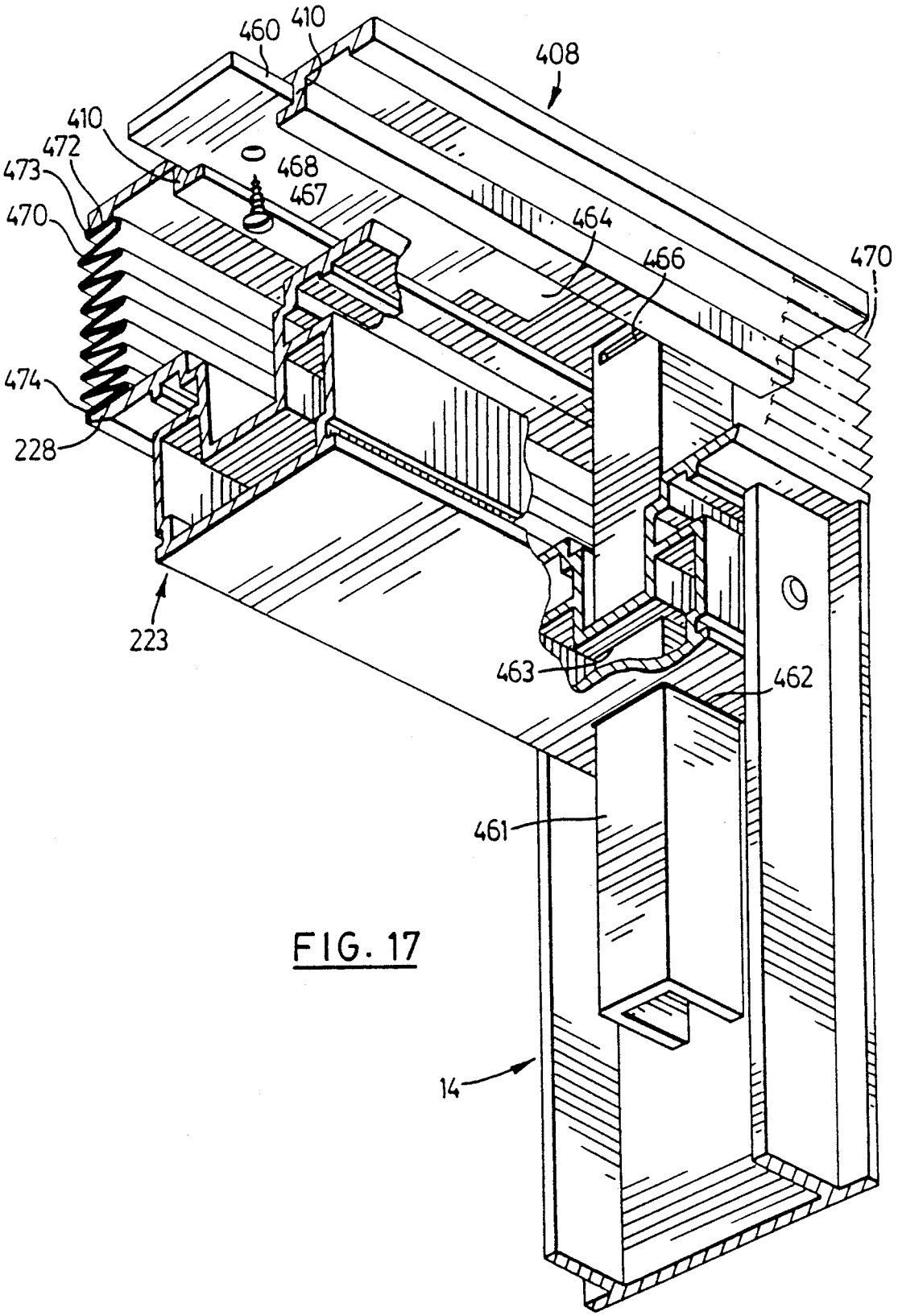

FIG. 8*a* is a vertical cross-section taken on the line 8—8 in FIG. 1 showing a clip-in form of connector used for retaining a horizontal capping plate on the upper side of a partition;

FIG. 8*b* is a vertical cross-section similar to FIG. 8*a* showing a threaded connector used for retaining the capping plate;

FIG. 9 is a partially fragmentary vertical cross-section through an upper part of a modified form of partition structure;

FIG. 10 shows a modified form of interconnector member for vertically adjacent frame elements;

FIG. 11 is a vertical cross-section through the adjacent rails of two frame elements connected using the member of FIG. 10;

FIG. 12 is a partial vertical cross-section through a lower horizontal rail of a modified form of partition structure;

FIG. 13 is a view corresponding to FIG. 6*a* showing a modified form of corner connector and snap-on extruded cover;

FIG. 14 is a horizontal cross-section of a modified snap-on cover;

FIG. 15 shows a horizontal cross-section through corners forming a T-joint;

FIG. 16 shows a horizontal cross-section through corners forming a cruciform joint; and FIG. 17 is a partially fragmentary perspective view from below of an upper quadrant of a modified frame element showing arrangements for connection of the partition structure to a ceiling.

Referring to the drawings FIGS. 1 to 8*b* show partition structures based on a first form of frame element and FIGS. 9 to 17 show structures based on a second form. In FIGS. 9 to 17 elements which are similar to those of FIGS. 1 to 8*b* are denoted by like reference numerals raised by 200.

FIG. 1 shows an angled or corner unit consisting of two sections 11 and 12 joining at a right angle. Each section consists of two sub-sections, 11*a* and *b* and 12*a* and *b*.

Figure 2:
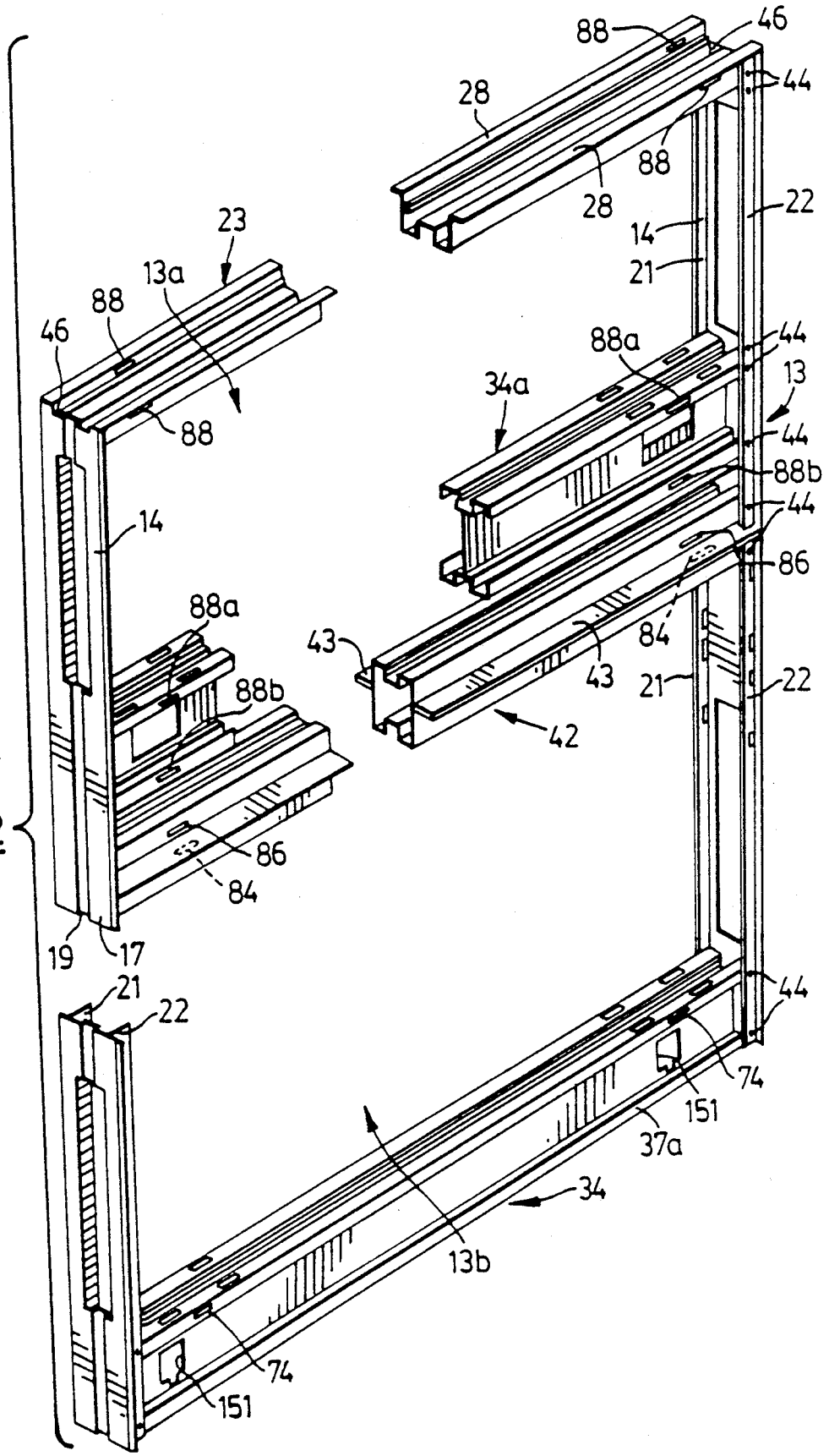
FIG. 2 is a partially fragmentary perspective view of one form of rectangular frame element used in the structure of FIG. 1.

The sub-sections are made up of assemblies of rigid rectangular frame elements on which cover panels and plates and capping plates are connected. FIG. 2 shows a base frame element 3 which constitutes the structural support of the partition sub-section 12*b*. On top of this element 13, modular rigid rectangular frame elements may be connected to form sub-sections of increasing height, such as the subsections 11*a*, 11*b* and 12*a*.

The element 13 comprises two continuous side rails 14 part of one of which is shown cut away in FIG. 2, to illustrate the section of the rail. The cross-section is also seen in FIG. 6*a*, and consists of a plate 17 with bevelled edges 18, a narrow central rectangular groove 19, and spaced rearwardly directed flanges 21 and 22. Desirably the rails 14 and all other continuous rails employed in and together with the frame elements are formed by extrusion. Preferably they are aluminum extrusions, but it will be appreciated that other metals or high-strength plastics materials may also be employed.

The element 13 has an upper continuous rail 23, the cross-section of which is best seen in FIGS. 4*a* and 4*b*. It is of generally rectangular channel section with a channel bottom 25 and sides 26 and 27. The width of the channel is such that it fits snugly between the flanges 21 and 22 of the side rails 14. Each channel side 26 and 27 has an outwardly-directed edge flange 28, these flanges 28 being coplanar and forming in effect a peripheral frame, in relation to which the channel sides 26 and 27 form inwardlydirected lips.

Each channel side 26 and 27 has an abutment shoulder 29 on its inner side, each with a downwardly inclining upper face 31.

The channel bottom 24 is formed with a rectangular channel section recess 32 opening into the interior of the frame element 13. Adjacent the mouth of the recess 32, a projection 33 extends inwardly from each side, to form a narrow opening to the recess 32.

Figure 3:
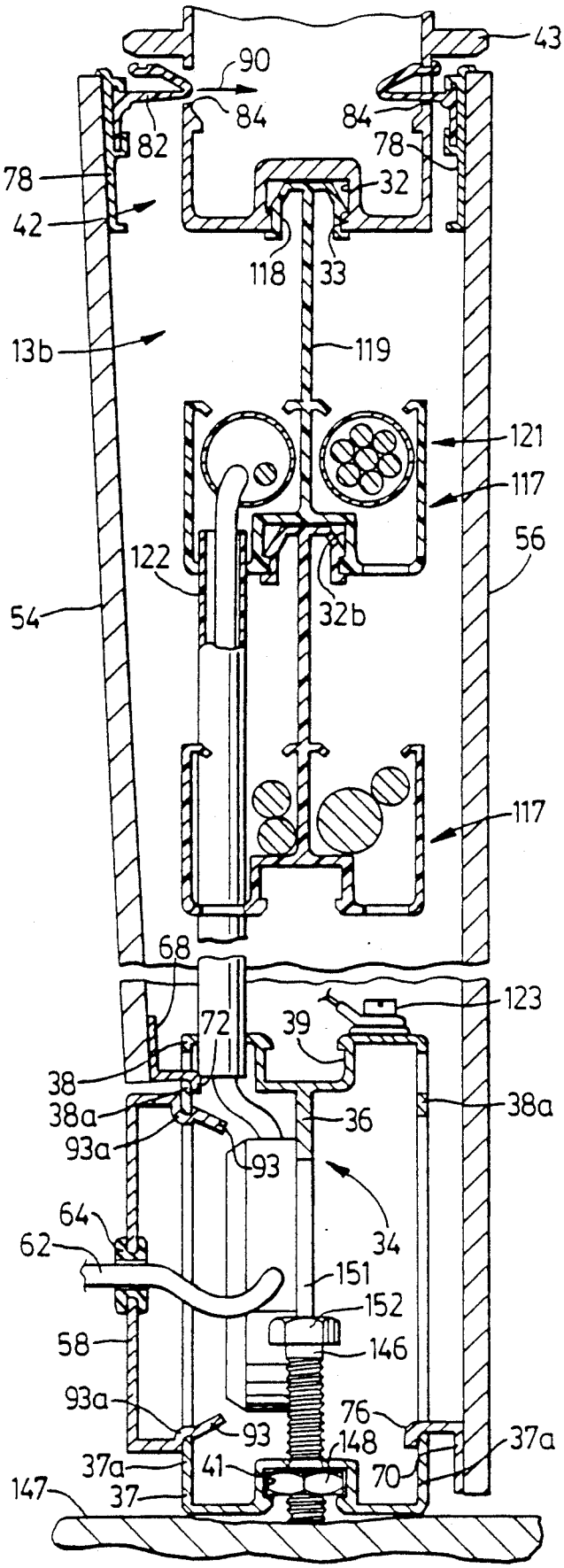
FIG. 3 is a partially fragmentary cross-section through a frame element as in FIG. 2 employed in forming the structure of FIG. 1, and taken on the line 3—3 in FIG. 1.

The continuous bottom rail 34 of the element 13, as best seen in cross-section in FIG. 3, is of generally I-shape. The I-shape beam offers a channel facing each side of the element 13. It has a vertical web 36, and laterally outwardly and then vertically extending upper and lower end flanges 37 and 38 extending in the plane of the element 13. Each end flange 37 and 38 is centrally-vertically recessed to provide a narrow-mouthed rectangular channel section recess 39 and 41, similar to the recess 32 in the rail 23. The vertical portions or lip flanges 37*a* and 38*a* of the end flanges 37 and 38 are laterally spaced so that they fit snugly between the flanges 21 and 22 of the side rails 14.

The elements 13 is provided with a hollow central cross beam 42, which as seen in FIG. 3 is of a unitary cross-section corresponding to that which would be obtained by placing together two of the extrusions 23 in inverted relationship. On each side, therefore, it has flanges 43 which are twice the thickness of the flanges 28.

Further, the element 13 is provided with a service cross beam 34*a*, formed from the same extrusion as the rail 34, and thus also offering a channel on each side of the element 13 for supporting sockets and receptacles for electrical outlets, telephone or other telecommunication services, computers and data processing and the like.

In assembling the frame element 13, the ends of the cross rails or beams 23, 34, 42 and 34*a* are butted to the inner sides of the side rails 14, between the flanges 21 and 22, and the cross beams or rails are secured with fasteners 44 such as self-tapping screws or rivets passed through holes in the flanges 21 and 22 in the side rails at points adjacent vertical sides of the cross beams or rails engaged therein. Preferably, as seen in FIG. 2, the flanges 43 of the hollow cross-beam 42 are notched at each end to receive the flanges 21 and 22. At the upper end of each side rail 14, the flanges 21 and 22 are notched so that the flanges 28 of the channel rail 23 run out to the side of the frame element. The upper end of each plate 27 is notched to provide a recess or recesses, for example as shown at 46 in FIG. 2, so that electrical cables 48 as shown in FIG. 6*a* may be run into the frame element from the exterior, over an upper corner of the frame element, and into the interior of the element through openings 50 stuck through the channel bottom 24.

The side rails 14 are also formed with cut outs, such as, for example, the cut outs 52, through which cables or other service conduits can be introduced into or run through the interior of the element 13.

It will be noted that the width of the side rails 14 is the same as the width of the flanges 28 on the channel rail at the flanges 43 on the hollow cross beam 42, so that on each side of the element, the edges of the flanges 28 and 43 are coplanar with the edges of the rails 14 and form a thin peripheral frame or border around the rectangular openings 13*a* and 13*b* defined between the beam 32 and rail 23 and side rails 14, and between the bottom rail 34, the cross beam 43 and the side rails 14.

In use, cover panels 54 and 56 and cover plates 58 are attached to the frame element 13 to enclose the open sides of the element and provide a partition structure in the form of a rectangular box-like housing. In the preferred form, a standard size of cover panel 54 is employed to cover both the upper opening 13*a* and the lower opening 13*b*. The panel 54 fits closely into the upper opening 13*a*, leaving a small clearance between the edges of the flanges 28 and 43, the side rails 14, and the edges of the panel 54.

Preferably, as will be seen from FIG. 3, the lower opening 13*b* approximately the same width as the opening 13*a* and, as seen in FIG. 3, may be closed with one of the standard-sized panels 54. A cover plate 58 forming a base board, which may be apertured to allow access to sockets or receptacles attached to the I-beam 34 may be connected to the I-beam 34, as seen in FIG. 3. The plate may have apertures through which cables 62 may be led, for example through a resilient grommet 64.

Alternatively, as seen on the right hand side in FIG. 3, a non-standard sized cover panel 56 may be employed to close one side of the opening 13*b* and cover the beam 34.

As noted above, sub-section 12*b* shown in FIG. 1 is formed by a base frame element 13 together with its cover panels 54 and plate 58. For ease of reference, the element 13 may be referred to as a "two high unit" since it normally is clad with two of the cover panels 54. To form a higher unit, such as sub-section 12*a*, a rigid rectangular frame element may be stacked on top of a base element 13. Such frame element is preferably dimensioned so that it can be clad with a single standard-sized cover panel 54 on each side, and is therefore conveniently referred to as a "one high unit". The frame element of such one high unit comprises side rails similar to the side rails 14, but of length equal only to the interval between the rail 23 and the cross bean 42 in FIG. 2, and upper and lower channel section rails rigidly joined thereto and formed of the same extrusion as the rail 23, these rails being disposed in inverted relationship to one another so that the larger channel faces outward and the smaller channel recess 32 faces inward.

Still taller units, such as the sub-sections 11*a* and 11*b* can be formed by stacking a further one high unit on a partition structure such as that of sub-section 12*a*. Alternatively, a "three high base unit" may be provided consisting of a rigid frame member comprising side rails similar to the side rails 14 but of length equal to the length of the side rails of the two high unit shown 13 in FIG. 2 plus the length of the sides of the one high unit. The frame has a bottom rail similar to the bottom rail 34, first and second hollow cross beams each similar to the cross beam 42 and spaced at intervals corresponding to the spacings of the cross beam 42 and rail 23 as seen in FIG. 2, and, as the uppermost horizontal member, a rail similar to rail 23. It will be appreciated, therefore, that the rectangular openings formed on each side of such three high unit are adapted to be covered or clad with a base board cover plate 56 and with three standard-sized cover panels 54, as shown in FIG. 1. On top of this three high unit can be stacked a one high unit, as indicated at sub-sections 11*a* and 22*b* in FIG. 1. Where, as indicated in sub-section 12*a* in FIG. 1, it is desired to provide a narrow cover panel 59 at an intermediate height, for example at approximately desk top height to provide access to sockets and receptacles provided in the partition structure at this height, the remaining portion of the opening in the side of the frame may be covered with a non-standard narrower cover panel 66 which is snugly received in the opening leaving only a small clearance between its edges and the adjacent edges of the frame.

Each of these panels 54 and 66 is held onto its frame element by a secure tamper-resistant catch mechanism , illustrated in FIGS. 3, 7*a* and 7*b*. Adjacent each side of the lower edge of the panel a small rectangular plate 68 or 70 for example of extruded aluminum or plastic, is attached as by an adhesive or with mechanical fasteners One style of the plate 68 is formed with a rearward flange with a laterally projecting edge flange extending away from the plate 68 and forming a hooklike projection 72. This projection can be engaged in a slot 74 formed adjacent each end of the bottom rail 34 in its upper vertical portion or lip 38*a*.

An alternative style of the plate 70 has a rearward flange with a hooklike projection 76 facing toward the plate 70. The projection 76 may be hooked over the free edge of the lower vertical portion or lip flange 37*a* of the bottom rail 34. The lower edge of each panel 54 and 56 is thus prevented from being pulled away from the element 13 by a direct outward pull on the edge of the panel, but is free to pivot or rock about the slot 74 or the lip flange 37*a*, respectively.

Adjacent each side of the upper edge of the panel 54 or 66 a piece of a generally L-section extrusion 78 is fastened or adhered, the angle of the L-section receiving the corner of the cross section of the panel. The extrusion 78 is formed with a rectangular channel section keyway 80 with reentrant lips, into which is inserted a length of a resilient, preferably plastics material, extrusion having a rectangular base 81 snugly received in the keyway and secured in the keyway with adhesive or fasteners. A generally U-shape tongue 82 extends rearwardly form the base 81 and is formed on its outer side with a rectangular channel 83 forming two opposing shoulders of width to snugly receive the edge of a slot 84 shown in broken lines in FIG. 2 formed in the material of the side wall of the hollow cross beam 42.

In the case in which the panel 54 is to be applied over the upper opening 13*a*, or over similar openings on a one high or three high unit, the lower hooklike projections 72 and 76 may be engaged with slots 86 formed in the side wall of the cross beam 42 or in corresponding positions in the side wall 26 or 27 of the channel section rail forming one side of the one high frame element. The tongues 82 can then be engaged in slots 88 in the side walls 26 or 27 of the channel rail 23 forming the opposite side of the opening, as seen in FIGS. 7*a* and 7*b*.

In each case, the tongue 82 resiliently engages the shoulders of its channel 83 with opposing sides of the material bordering the slot 84 or 88 when the upper end of the panel carrying the tongue is pressed home as indicated by the arrow 90 in FIG. 3. The panel edge is thereby securely held against disengagement from the frame element when an outward pull is applied to the edge. As noted above, the panels 54, 56 and 66 are held on their respective frame elements with only a small clearance between their edges and the adjacent frame sides formed by the flanges 28 or 43. Accordingly, the free ends of the tongues 82 are practically indiscernible unless the edges of the panels are very closely inspected.

In order to free the panel from its mounted position, a thin-bladed tool such as a putty knife 92 may be inserted through the clearance adjacent the panel edge in order to apply inward pressure on the tongue 82, deflecting it resiliently inwardly as shown in FIG. 7*b*, so that the channel 83 is freed from the edge of the slot. The panel edge can then be rocked outwardly about the pivoted connection provided by the hook 72 or 76 allowing access to electrical equipment within the partition or if desired the panel can be lifted to free the hook 72 or 76 from its engagement, thus allowing the panel to be removed In assembling the partition, or substituting a replacement panel, the above procedure for disassembly is followed in reverse order.

Referring again to FIG. 3, the cover plate 58 preferably comprises a length of resilient plastic extrusion formed with rearwardly and inwardly directed flanges 93 formed with grooves 93*a* which snap fasten between the vertical portions 37*a* and 38*a* of the bottom I section rail 34.

In one alternative form, the upper opening 13*a* of the element 13 shown in FIG. 2 may be clad with an upper cover panel having U-shaped catches similar to the catches 82 received in the slots 88, and hooks such as hooks 72 or 76 received in slots 88*a* in I-beam 34*a*. A plate similar to plate 58 may be snap fastened between the vertical lip flange portions of the beam 34*a*. A narrow cover panel may be attached with U-shaped tongue catches to slots 88*b* in the lower portion of beam 34*a* and with hooks attaching in slots 86. As will be appreciated from FIGS. 2 and 3 a panel 54 when applied on upper opening 13*a* extends outwardly of the sides of the beam 34*a*, and therefore the opening 13*a* may be covered either with a panel 54 or it may have applied to it a narrower panel such as panel 66 together with a plate similar to plate 58 snapped onto the beam 34*a*.

The base unit used for the subsection 12*a* may, for example, have an I beam similar to beam 34*a* at approximately the position occupied by hollow beam 42 in FIG. 2. The I beam may receive cover plate 59 which may be a snap-in plate similar to plate 58.

As will be appreciated, various other styles and designs of frame elements may be employed.

Referring to FIGS. 4*a* and 4*b*, these show an arrangement for connecting a frame element having a channel section rail 23*a* along one side, such as a one high unit as described above, on a frame element having an upper channel section rail 23, such as a two high unit as shown in FIG. 2, or a one high or three high unit as described above.

Short lengths of an extruded frame interconnector member 94 are employed. Typically, two or more pieces of the extrusion, e.g. of a few inches in length, are employed at spaced intervals along the length of the channels 23 and 23*a* of the frames to be connected. The interconnector 94 comprises a resiliently compressible channel section which as seen in FIGS. 4*a* and 4*b* is introduced within the rail 23 in inverted position. Each channel side of the interconnector 94 has an outwardly extending engaging rib 96 on its free end, each rib preferably being profiled with an outwardly downwardly inclining surface, so that a camming action is exerted between the ribs 96 and the faces 31 of the shoulders 29 when the member 94 is pushed into the channel of the rail 23, tending to compress the channel sides of the member 94 inwardly and assisting in introduction of the member 94.

The central portion of the channel bottom of member 94 is thickened and is pierced with an aperture which is engaged by a threaded stud 98 passed freely through an opening 100 formed in the bottom of the channel recess 32*a* of the opposed channel 23*a*. The openings 100 are formed through the channel 23*a* at the points where it is desired to employ a member 94, and the members and stud 98 are preferably preassembled to channel 23*a* as shown in FIG. 4*a*.

After introduction of the members 94 into the channel 23, the stud 98 is tightened up so that a compressive force is applied between the ribs 96 and shoulders 29, and the rail 23*a* of the upper element is clamped firmly on top of the rail 23 as shown in FIG. 4*b*, its edge flanges 28*a* seated on the flanges 28.

In the preferred form as shown, the height of the channel of the member 94 is such that it extends into both rails 23 and 23*a* in the clamping position shown in FIG. 4*b*. The width of the channel of the member 94 is such that it is snugly received between the shoulders 29 in the lower rail 23 and the shoulders 29*a* in the upper rail 23*a*. An intermediate portion of each channel side of the member 94 is thickened at 101 to provide a land or outer surface abutting the inner sides of the free ends of the superimposed channels 23 and 23*a* in the clamping position as shown in FIG. 4*b*. Hence, with the preferred form as shown there is no lateral play or freedom of movement between the rails 23 and 23*a* adjacent the interconnector member 94 so that the stability of the connection is increased.

The channel recess 32*a* in the base of the rail 23*a* receives the head of the stud 98 in the clamped position as shown in FIG. 4*b* so that this will not intrude into the space within the frame element above the channel 23*a* and will not interfere with cables or other equipment to be placed within the frame element above the rail 23*a*.

In assembling a partition structure such as shown in FIG. 1, vertically adjacent frame elements are preferably held together using connector members such as shown in FIGS. 4*a* and 4*b*. Horizontally adjacent frame elements are preferably held together with simple mechanical fasteners such as nuts and bolts passed through holes drilled through the side rails 14 of adjacent elements.

Where it is desired to form an angle between two horizontally adjacent elements, as shown in FIGS. 1 and 6*a*, a multiply-lobed connector element 103 or 105 such as shown in FIG. 6*a* or 6*b* is preferably employed.

In each case the connector 103 or 105 is formed as an extrusion, preferably of aluminum, or of other metal, or high-strength plastic, of the cross-section shown, and short pieces are cut off to provide connector elements which are applied at uniformly spaced intervals, e.g. every few feet up the side of the partition structure. Each lobe of each connector has a thickened generally rectangular crosssection end portion 106 joined by a narrower stem 107 to a central portion 108. The outer face of each end portion 106 has a channel section recess 109 in it with serrated edges which receive screws 111 which are passed through holes drilled through the plates 17 of the side rails 14 at the points where the connector elements 103 or 105 are to be employed.

The outer face of each end portion 106 is provided with a pair of rectangular projections or stub flanges 112 dimensioned so that they fit snugly in the central rectangular groove 19 on the outer side of the rails 14, so that the connector members 103 or 105 are securely located against lateral movement relative to the rails 14.

If the outer sides of the corner shown in FIG. 6*a*, employing the cruciform connector 105, are exposed, they can be given a neat appearance by applying corner cover plates in the positions shown in broken lines at 113 and 114. Such plates, preferably extruded from aluminum, have adjacent their center a pair of rearwardly-directed flanges each with a reentrant lip at its free end. The flanges are sufficiently thin that they can be flexed resiliently outwardly to enable them to be snapped onto the thickened end portion 106 of the connector.

FIG. 6*b* shows a connector with its lobes arranged at 120°, so that, for example, a hexagonal island of the partitions can be formed.

A similar connector of generally T-section can also be employed.

As seen in FIG. 6*a*, the outer ends of the partition structures may be capped with a vertical capping plate 116 preferably an aluminum extrusion of the cross-section shown, which is screwed to the outer side of the side rail 14, with screws passed through openings drilled at intervals through the central portion of the rail 14.

Referring again to FIG. 3, this shows snap-in resilient plastics cable carriers 117 used for supporting cables 118 run through the interior of the base element 13.

The carriers 117 are preferably extruded and usually are employed in the form of pieces of a few inches in length cut from the extrusion. The upper portions of the carriers 117 are adapted to snap couple into the channel sections recess 32 formed in the lower side of the hollow cross beam 42. The carriers are laterally symmetrical and their upper portions comprise laterally outwardly and downwardly extending wings 118 each formed on its outer side with a rectangular section groove which engages the rectangular projections 33 bordering the mouth of the recess 32 including their upper sides. In the snapped-in position shown in FIG. 3 the wings 118 are laterally compressed between the projections 33 so that they are held tightly in place and resist withdrawal although they can be slid longitudinally along the recess 32. The lower ends of wings 118 emerge from the recess 32 so that they can be engaged e.g. with the blade of a screw driver to compress them internally so that they can be freed from the recess if desired.

Each carrier includes a central wall or septum 119 connecting to a lower portion 121 having an upwardly extending cable supporting channel on each side. The lower face of the carrier is formed with a recess 31*b* similar in cross-section to the recess 32 so that a similar cable carrier can be snap coupled into it, as seen in FIG. 3.

Plastic conduits 122 may be passed through openings in the cable supporting channels of the cable carriers 117 in order to convey cable between upper and lower regions of the partition.

One further advantage of using frame elements formed from aluminum or other metal is that they can serve to ground electrical components using for example a grounding screw 123 engaging a rail such as the rail 34.

FIGS. 5*a* and 5*b* show an arrangement for connecting the partition structure to a ceiling 126. At the point where it is desired to position the partition, a rectangular section bar, for example a wooden plate or stud or a hollow rectangular section metal rail 127 as shown is secured to the ceiling with fasteners 128. A resilient channel section ceiling connector member 129 is used to connect the rail 127 to an upwardly open channel 23*b* forming a top rail of a partition structure, which may be for example a one high unit as described above.

The connector member has a flange 131 extending inwardly and preferably downwardly from each of its channel sides 132, and its channel bottom 133 is formed with a rectangular section depression 134 providing parallel opposing side surface 136 and 138 spaced apart the width of the channel in the rail 23. In use the connector member 129 is applied over the rail 127 with the flanges 131 resiliently gripping the sides of the rail and is pushed to an upper assembly position as shown by the arrow 140 in FIG. 5*a*. The partition including the rail 23*b* is then erected, usually flat on the floor, and then rocked upwardly to a position underneath the connector 129 and the rail 127 as shown by the arrow 141. The connector 129 is then pulled downwardly relative to the rail 127 as shown by the arrows 142 in FIG. 5*b* until the rectangular depression 134 engages the upper end of the channel rail 23*b* with the side surfaces 136 and 138 snugly engaging the opposing channel sides and retaining the partition structure against lateral movement. If desired, a screw 144 may be passed through an opening drilled through the channel bottom of the rail 23*b* and into the base of the connector member 129 in order to provide a connection with greater resistance to any lateral movement.

Referring again to FIG. 3, this shows a leveller bolt 146 which in the example shown is used to raise the bottom rail 34 of the base element 13 slightly above the surface of the floor 147 in order to level a partition structure where the floor surface is uneven. The bolt 146 may be threaded into a threaded opening in the rail 34 itself where the rail is of sufficient hardness but where, as in the preferred form the rail 34 is an aluminum extrusion, the bolt is preferably threaded through a hexagonal nut 148. The nut 148 is of such size that it fits snugly within the lower channel recess 41 in the rail 34. Opposing flat sides of the nut 148 engage the opposing channel sides of the recess 41 so that the nut is non-rotatable. Each bolt 146 is accommodated in a rectangular cut out 151 also seen in FIG. 2 so that it is accessible by a wrench or like tool, and is passed through a hole drilled through the bottom of the recess 41. The bolt 146 is arranged with its toolengaging head 152 uppermost and its threaded shank extending downwardly so that where, as is frequently the case, the floor surface 147 is perfectly even, the bolts 146 can be kept in retracted condition within the bottom rail 34, so that normally they are not visible.

FIGS. 8*a* and 8*b* show alternative arrangements for retaining a horizontal capping plate 154 on the top of an upper channel section rail 23 of a partition structure such as the two high base unit of FIG. 3. The plate 154 is preferably an aluminum extrusion and on its lower surface carries a pair of spaced inwardly directed generally L-shaped flanges 156, and a central pair of spaced flanges 158, the inner sides of which are serrated.

In FIG. 8*a* a resilient, preferably extruded aluminum, connector member 160 is employed, usually in the form of short pieces spaced at regular intervals along the length of the plate 154. The connector is formed with outwardly directed spaced L-shaped flanges 162 and normally the connector is engaged with the plate 156 at one end and slid along the plate to the desired positions with the flanges 162 engaging the flanges 156 as shown. The connector has resilient outwardly and downwardly extending flanges 164 terminating in inwardly extending portions 166 which through camming action on the upper side of the shoulder 29 are compressed inwardly allowing the plate 154 with the connector members 160 to be snap assembled to the position shown in FIG. 8*a*.

In FIG. 8*b*, threaded studs 168 are passed at intervals through holes drilled at intervals in bottom of the channel recess 32 and engaged the serrated sides of the flanges 158 to retain the cap 154.

As shown in FIGS. 9, 12 and 13 to 17 a modified form of frame element 213 has horizontal extruded rail members 223 in the form of a generally rectangular box section 401 formed with a channel section recess 402 in its outer side. Each wall of the recess 402 connects through a transition section 403 to an outwardly directed edge flange 228. There is an inwardly directed rib 404 aligned with each outer side 405 of the box section 401. The ribs 404 and outer sides 405 together define the inwardly-directed lips on which panels such as the panels 254 are connected. The longitudinally continuous opening between the lips 404 and the adjacent side of the box section 401 form the slots which receive U-shaped resilient notches 282 similar to the catches 82.

As seen in FIG. 9, the extruded central cross-beam 242 has the profile corresponding to two of the rails 223 placed with their edge flanges 228 face to face. It has continuous recesses 286 for receiving hooked plates 268.

The inner end of the box section 401 may be formed with square section recesses 406 onto which may be snap coupled resiliently deflectable wings of extruded plastic cable carriers similar in function to the carriers 117 described above with reference to FIG. 3.

A frame element can be formed using cross beams 242 and rails 223 together with vertical side rails 14 as described above and generally in the same manner as described above with reference to FIG. 3.

As shown in FIG. 9, a modified form of extruded capping plate 354 comprises a flat plate 408 formed with two parallel walls 410 on its under side. Each wall has an inwardly directed edge flange 412 parallel to the plate 408. Co-extruded plastic connectors 410 are used to connect the plate 354 to the upper side of the rail 223. The coextrusion 410 is mainly of a hard rigid plastic forming two spaced walls 414 connected by a yoke 416. In the upper end of the outer side of each wall 414 a groove is formed which receives a respective edge flange 412. Co-extruded on the outer sides of the lower portions of the walls 414 are upwardly and outwardly directed fins 418 formed from a soft resiliently flexible plastic.

In use, short lengths, e.g. of 3 cm, are severed from the co-extrusion 410 and are slid along the plate 354 with the grooves engaging the flanges 412 to be spaced at intervals, e.g. of 100 cm., along the length of the plate 354. The plate 354 together with the connectors 410 are then pressed downwardly into the channel 402 of the rail 223. The fins 418 are compressed inwardly and flex outwardly to resist withdrawal. The sides of the channel 402 may be finely serrated, as seen in FIG. 9, to improve the frictional grip of the fins 418.

FIG. 10 shows a rectangular section block 420 used for interconnecting vertically adjacent frame elements having like horizontal box section rails 223 on the upper side of the lower element and on the lower side of the upper element. The block 420 has a threaded bore 421 therethrough. At the points at which interconnections are to be made, openings 422 are drilled or otherwise formed through the inner wall of the box-section and through the bottom of the channel 402. A block 420 is placed at each point and a bolt 424 threaded upwardly into the lower end of the bore 421 and tightened up with a tool introduced through the lower opening 422, so that the head of the bolt engages the underside of the channel bottom. The upper frame element can then be applied and a similar bolt 424 introduced and tightened through the upper opening 422.

FIG. 12 shows a modified I-beam extruded section 234 which may constitute the lower rail of a two high or similar frame element and which may be employed as an intermediate service cross beam similar to the beam 34*a*. FIG. 12 shows the beam 234 used as the lower rail of a frame element and housing a levelling arrangement. In this instance, the beam is formed integrally with a box section 426 and 428 at its upper and its lower ends. At points where the levelling means are to be disposed, openings 429 are formed through the inner and outer sides of each of the box sections 426 and 428 and in the central web 236 of the I-beam. The lower box section 428 is formed with parallel ribs 430 nonrotatably capturing a flat sided nut 432. The lower side of the box section 428 projects horizontally inwardly to support the nut 432. The nut 432 has a threaded opening in which is threaded a stud 434 with a threaded shank 436 and a head 438 with a slot 440 having planar vertical surfaces so that the head 438 can be rotated to raise or lower the stud 436 relative to the beam 234. Thus, the leveller means operates in a manner similar to that described above with reference to FIG. 3. The greater length of the stud 434 as compared with the bolt 146 give greater levelling capacity. Normally the head 438 of the stud 434 is housed within, or below the upper side of, the box section 426 so that it does not interfere with cables or wiring running within the frame element.

It will be noted that the upper outer side of the I-beam 234 is formed with an inwardly directed flange 442 terminating in an end flange 443 parallel to the side of the box section 426. The side of the section 426 and the flange 443 correspond to the lip flange 38*a* of the I-beam 34 described above with reference to FIG. 3, and the recess provided by the flange 442 provides a slot which can receive a hook-shaped plate such as the plates 68 or 268 on a cover panel 54, 66 or 254.

FIG. 12 also shows modified forms of extruded resilient cover plate 258 provided with rearwardly inwardly directed flanges 293 having groove formations for snap coupling between inwardly directed flanges 444 formed on the lower and upper side regions of box sections 426 and 428, respectively.

FIGS. 13 to 16 show modified forms of connector for connecting frame elements together at corners. These connectors are used together with frame elements having vertical side rails 14 the same as the rails 14 described above with reference to FIGS. 2 and 6*a*. As with the connectors 103 described above with reference to FIG. 6*a*, the connectors 303*a*, 303*b* and 303*c* shown in FIGS. 13 to 16 are formed from short lengths severed from extrusions. They are connected to the side rails 14 of the frame elements with screws 111 passed through holes drilled through the side rails 14 and through the connectors 303*a* to *c*. As with the arrangement described above with reference to FIG. 6*a*, such lengths of connector 303*a* to c are connected to the outer sides of the side rails 14 at vertical intervals, for example of about 200 cm., in order to provide an adequately rigid and strong corner connection. As with the connectors 103 described above, the connectors 303*a* to c comprise arms connected together at right angles but in this instance the connectors 303 have arms 446 which join together adjacent the side edges of the side rails 14. They therefore leave open a relatively large space 448 within the rectangular area defined by the intersection of the side rails 14 projected outwardly, so that wiring can be passed freely upwardly along the outer sides of the side rails. The space 448 can accommodate cables or electrical connectors of larger cross-section than is possible with the arrangement of FIG. 6*a*.

FIGS. 13, 15 and 16 show connectors 303 of angle section, U-section and square-section, respectively, for forming corresponding corner structures or T-section or cruciform section corner arrangements.

The connectors 303*a* and 303*b* are further modified in that the outer free end of each of the arms 446 is formed with a snap coupling formation, in this instance a rib 449, which can more securely snap couple with corresponding grooves formed on rearwardly directed wings 450 formed on extruded resilient covers 451*a*, *b* and *c* shown in FIGS. 13, 14 and 15. Lengths of such covers 451, which may be of, for example thin extruded aluminum or resilient plastic, are applied to the outer sides of the frame elements at the corner to conceal the outer sides of the side rails 14, corner connectors 303, and any vertically extending wiring. FIGS. 13 and 14 show right-angle section and convexly arcuate section covers 451*a* and b which may be applied at a right angled corner according to design requirements or preference.

As with the connectors 103 and !05 described above, the connection portions or arms 446 are formed with rectangular projections 452 which locate in the central rectangular grooves 19 in the outer sides of the side nuts 14 so that the connectors 303 are retained against lateral movement relative to the rails 14.

FIGS. 9 and 15 show preferred arrangements for connection of glass panels 453 on an opening of a frame element 223, whereby windows may be provided. As with the panel described with reference to FIG. 3 above, a length of a keyway extrusion 78 is connected along the upper edge of the panel 453, and a length of a hooked extrusion 68 along the lower edge.

The extrusions 68 and 78 may be adhered to the inner side of the glass with glue or with double-sided adhesive tape (not shown). U-shaped resilient catches 82 are provided in the keyway 80 at intervals so that the panel 453 may be attached to the upper and lower or cross ribs 223 and 242 in the manner described above with reference to FIGS. 3, 7 and 7*a*.

A resiliently compressible sealing or gasketing strip 454, for example of resilient plastic foam, is preferably applied, for example using its own tacky adhesive coating, on the inner sides of the extrusions 68 and 78, in positions such that the strips 454 will be compressed against the outer sides of the box-sections 401 in the closed positions of the panels, for example as shown with the panel 254 in the right hand half of FIG. 9. The strip 454 seals the horizontal gap between the panel 453 and the horizontal rails of the frame element, and biases the panel 453 outwardly, thus preventing any tendency for the panel 453 to rattle in its mounted position.

The vertical gap between the side rails 14 and the panel 453 is sealed with a further gasketing arrangement shown in FIG. 16. The gasket employs a co-extruded generally channel shape plastics member 455. The channel bottom and side walls of the member 455 are of relatively hard, stiffly flexible plastic and are spaced so that they grip compressively on the outer sides of the flanges 21 and 22 of the side rail 14. Preferably, the inner side of each wall of the channel 455 is formed with raised ribs 456 which engage the flanges 21 and 22. These ribs 456 may be coextruded with the channel and are of a softer plastic which tends to deform and to grip with greater friction on the flanges 21 and 22.

The outer sides of the walls of the channel 455 each have co-extruded on them a soft, resiliently flexible fin 457 which normally extends outwardly at an acute angle from the side wall. In the closed position, as seen in FIG. 16, the panel 453 compresses the fin 457 inwardly so that this forms a gasket or seal pressing resiliently against the inner face of the panel.

As will be appreciated, normally a glass panel 453 is employed on each side of a glazed opening, and the gasketing strips and fins 454 and 457 can be employed to seal the opening in the frame element from the exterior by sealing the edges of each glass panel 453 to the rails 223 and 14. The gasketing therefore provides sound proofing and prevents ingress of dust to the interior of the glazed opening.

The rails used in the construction of the frame elements may be black anodized aluminum, or at least the inner sides of the horizontal rails or beams 223 and 242 may be matt black coated or painted, and the channel 455 may be extruded from matt black plastic or may at least be painted or coated matt black on the exterior of the channel bottom, so that a neat matt black interior frame is visible through the glass panels.

FIG. 17 shows an arrangement for connecting one upper quadrant of a frame element to a ceiling. Normally, a similar arrangement is used at each end of an upper side of a frame element or at least at each end of a number of horizontally adjacent interconnected frame elements, where it is desired to connect the position structure to a ceiling.

Along the line of the intended position of the top of the partition structure, a ceiling rail consisting of a length of the extrusion 408 as also shown in FIG. 9 is attached to the ceiling, for example with fasteners (not shown) passed upwardly through holes drilled through the rail 408 and into the ceiling. A sliding latch plate 460 is introduced into one end of the recess formed by the walls 10 and is supported for horizontal sliding in the recess by the re-entrant edge flanges 412. Adjacent the side rail 14, the frame element is provided with a vertically slidable latch bar 461. In the example shown the bar 461 is a length of square channel section extrusion. As will be seen from FIG. 9, the channel between the walls 410 of the ceiling rail 408 is the same width as the channel recess 402. The bar 461 fits between these channels with a snug sliding clearance and passes through rectangular notches 462 and 463 formed with similar snug sliding clearance in the lower wall of the box-section 401 of the rail 223 and in the channel bottom defining the recess.

In use, the partition structure having the notches 462 and 463 therein is assembled usually flat on the floor, and then rocked upwardly to a position underneath the rail 408. The bar 461 is inserted through an opening of the frame element and slid upwards to the upper engaged position shown in FIG. 17 with finger pressure of one hand applied to the lower edge of the bar 461 to maintain it in its upper position. In the upper position, the sides of the bar 461 are received with a small clearance between the sides of the flanges 410 and thus lateral movement of the upper end of the partition relative to the rail 408 is resisted. The finger of the other hand are then used to slide the latch plate 460 along the channel of the rail 408 from the position shown in FIG. 17 to a lateral position in which a narrow rectangular section end portion 464 of the plate 460 enters a rectangular section aperture 466 formed in the adjacent side of the bar 461. The portion 464 is a close fit in the aperture 466 and the plate 460 is a sliding fit in the channel of the rail 408 and the reaction between these members again resists lateral movement of the partition relative to the rail 408. Although normally friction between the sides of the aperture 466 in the bar 461 and the portion 464 are sufficient to maintain the parts in the latched position, if desired the security of the connection can be increased by tightening up with finger pressure a screw 467 introduced upwardly into a threaded hole 468 in the plate 460 to engage the rail 408.

To cover the gap between the upper side of the partition and the rail, a resiliently compressible bellows-like filler strip 470 is applied between the two members. The strip 470 comprises a horizontally pleated member extruded from resilient plastic. A strip 470 is used which has its width less than the gap to be filled so that the upper and lower webs of the strip 470 are engaged compressively by the edge flange 472 of the rail and the flange 228 of the rail 223, and friction between the strip 470 and these flanges holds the strip 470 in place. The upper and lower edges of the filler strip are formed with short edge flanges 473 and 474 which engage the outer edges of the flanges 472 and 228 and limit insertion of the strip 470 as it is pressed inwardly into the gap, so that the strip aligns neatly with the edges of the rails 408 and 223.

What I claim is:

1. A modular partition structure comprising a plurality of rectangular frame elements formed by peripheral rails defining rectangular openings of uniform size therein, a plurality of rectangular panels of uniform size attaching to said frame elements substantially to fill said openings, and at least one of said frame elements being provided with a service cross beam for carrying electrical and telecommunication service members, said beam extending across an intermediate portion of one of said openings and connected at opposite ends to opposite peripheral rails of the frame element, and including a narrow panel attaching to said cross beam and to a peripheral rail of the frame element parallel thereto and substantially filling the space therebetween, and a cover plate attaching to and covering said cross beam, wherein said cross beam is of generally I-section with the upright of said I disposed parallel to the plane of the frame element, wherein said beam offers a channel section recess on each face of the frame element.

2. A partition structure as claimed in claim 1 comprising attachment means supporting said uniform panels on said peripheral rails with said panels extending on the outer side of said cross beam, whereby each opening of said frame element having the cross beam may be provided selectively either with one of said uniform panels substantially filling said opening or with said narrow panel and said cover plate.

3. A partition structure as claimed in claim 1 wherein each end of said I-section is provided on each side with an end flange extending in the pane of the frame element, said end flanges having slots formed therein for connection of the edges of said narrow panel thereto.

4. A partition structure as claimed in claim 3 wherein said cover plate is resilient and snap fits between said end flanges of said I-section beam.

5. A two high modular partition structure comprising in combination a frame element having two vertical side rails, a horizontal top rail and a horizontal central rail connecting between the side rails, a horizontal bottom cross beam connecting between the side rails for carrying sockets or receptacles, and an intermediate horizontal cross beam disposed between the top and central rails and connecting at each end to said side rails for supporting sockets and receptacles, cover plates for connecting to said bottom and intermediate horizontal cross beams, a plurality of uniform sized rectangular panels for attaching to said frame element outwardly of said cross beam substantially to fill the openings between said top and central rails and between said central rail and the bottom cross beam, and a cover panel for attaching to said frame element and narrower than said uniform sized panels to fill the opening between the intermediate cross beam and the top rail, whereby the opening between the top rail and the central rail can have applied to it selectively (a) one of said uniform sized rectangular panels or (b) a dover plate and said narrower cover panel and, wherein said horizontal bottom cross beam and intermediate horizontal cross beam are each of generally I-section with the upright of said I disposed parallel to the plane of the frame element, whereby each said beam offers a channel section recess on each face of the frame element.

* * * * *